US008676070B2

(12) United States Patent
Koshimura et al.

(10) Patent No.: US 8,676,070 B2
(45) Date of Patent: Mar. 18, 2014

(54) IMAGE FORMING APPARATUS

(75) Inventors: Yasushi Koshimura, Tokyo (JP); Kazuteru Ishizuka, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 177 days.

(21) Appl. No.: 13/353,361

(22) Filed: Jan. 19, 2012

(65) Prior Publication Data

US 2012/0189333 A1 Jul. 26, 2012

(30) Foreign Application Priority Data

Jan. 26, 2011 (JP) ..... 2011-013893

(51) Int. Cl.
*G03G 15/14* (2006.01)

(52) U.S. Cl.
USPC ..... 399/49; 399/66; 399/299; 399/302

(58) Field of Classification Search
USPC ..... 399/49, 66, 299, 300, 302, 308
See application file for complete search history.

(56) References Cited

U.S. PATENT DOCUMENTS 6,564,021 B1 * 5/2003 Nakai et al. ..... 399/49
2011/0222128 A1 * 9/2011 Wada ..... 358/3.27

FOREIGN PATENT DOCUMENTS

JP 2006-189562 7/2006
JP 2007-065269 3/2007
JP 2007-241117 9/2007

* cited by examiner

*Primary Examiner* — David Gray
*Assistant Examiner* — Carla Therrien
(74) *Attorney, Agent, or Firm* — Lucas & Mercanti, LLP

(57) ABSTRACT

The image forming apparatus has
a first and a second transfer member which transfer toner images onto a transfer body; and
a control section, which measures a first density of a first toner image formed on the transfer body, measures a second density of a second toner image formed on the transfer body and determines a transfer current for the first and the second transfer member based on the first and the second density.

9 Claims, 12 Drawing Sheets

IMAGE FORMING APPARATUS

RELATED APPLICATION

The present application is based on Patent Application No, 2011-013893 filed at the Japan Patent Office on Jan. 26, 2011 and which is hereby incorporated herein in its entirety.

TECHNICAL HELD

The present invention relates to an improvement of the transfer process in an image forming apparatus to form an image by an electrophotographic process.

BACKGROUND

In an image forming apparatus referred to as a tandem-type, toner images having been fanned in a plurality of tone image fanning sections are transferred onto a transfer body to form a toner image superimposed on the transfer body. The toner image on the transfer body is fixed to form a recorded image or transferred onto a recording medium, followed by being fixed to farm a recorded image.

Toner images having been formed in a plurality of toner image forming sections are transferred onto a moving transfer body in the sequential order from the upstream. Japan Unexamined Patent Publication 2007-241117discloses that a toner to form a toner image having been formed on a transfer body via transfer in the upstream is prevented from being reversely transferred onto the photoreceptor of a toner image forming section of the downstream from the transfer body. Incidentally, in the following description, reverse transfer is referred to as back-transfer.

Initially, back-transfer will be described below.

In FIG. 1*a*, a toner image T1 on the photoreceptor PC1 of a toner image fanning section G1 on the upstream side is transferred onto a transfer body TM by a transfer member TR1 to form the toner image T1 on the transfer body TM in FIG. 1*b*.

In FIG. 1*c*, in a tone image forming section G2 on the downstream side, a toner image T2 on the photoreceptor PC2 is transferred onto the transfer body TM by a transfer member TR2, but in the transfer member TR2, a part T1*b* of the toner image T1 which is being formed on the transfer body TM is transferred onto the photoreceptor PC2 of the toner image forming section G2 from the transfer body TM in FIG. 1*c* and in FIG. 1*d*, then on the transfer body TM, a toner image T1*a* and the toner image T2 are fainted. As shown in FIG. 1*d*, the toner image T1*a* is formed with a smaller amount of a toner than the toner image T1, resulting in density decrease due to back-transfer in the downstream.

FIG. 2 shows the relationship between transfer current and back-transfer.

The vertical axis represents the toner amount of a toner image on the transfer body TM, and the horizontal axis represents the transfer currents in the transfer members TR1 and TR2. Curve shows the change of the toner amount of a toner image T1 transferred on the intermediate transfer body TM from the photoreceptor PC1 by the transfer member TR1 in the toner image forming section G1 on the upstream side. Curve L2 shows the toner amount of a toner image T1*b* having been transferred on the photoreceptor PC2 from the transfer body TM by the transfer member TR2 in the toner image forming section G2 on the downstream side.

As shown in the figure, the toner amount of a toner image T1 on the transfer body TM and the toner amount of a toner image T1*b* on the photoreceptor PC2 change in response to the change of the transfer currents in the transfer devices TR1 and TR2. The toner amount of the toner image T1 increases with the increase of the transfer current and reaches the maximum value at 50 μA, decreasing then with the increase of the transfer current at 50 μA or more. The toner amount of the toner image T1*b* increases with the increase of the transfer current.

Curve L1 shows changes in response to the change of the transfer current in the transfer member TR1 with respect to a toner image T1 having been formed in the toner image forming section G1, and then changes in response to the change of the transfer current in the transfer member TR2 with respect to a toner image T2 having been formed in the toner image forming section G2 is also shown in the same manse as in curve L1. Therefore, to increase the density of a transferred image of the toner image T2 by increasing the transfer rare of the toner image T2 having been formed in the toner image fanning section G2, the transfer current is preferably allowed to be 50 μA. However, there is produced a problem such that when the transfer current in the toner image forming section G2 increases, the back-transfer amount with respect to the toner image T1 having been formed in the image forming section G1 increases as shown by curve L2.

Therefor, it is necessary to balance ensuring of transfer efficiency and inhibition of back-transfer, For such a balance, appropriate adjustments from the viewpoint of inhibition of color shade change in a color image, ensuring of density, and control of toner consumption are required. Ensuring of density is contrast to control of toner consumption. When an image of high density is obtained at small transfer rate, a toner image with, a large amount of a toner is formed in development and then the amount lost in transfer is replenished. However, when such a method is carried out, the amount of the transfer residual toner is increased and then toner consumption is increased.

In Japan Unexamined Patent Publication 2007-241117, the transfer current in a transfer member on the downstream side is allowed to be smaller than that in a transfer member on the upstream side to prevent back-transfer. Japan Unexamined Patent Publication 2007-241117 does not make clear how the transfer current in the transfer member on the downstream side is set low.

Problems such as inhibition of color shade change, ensuring of density, and control of toner consumption cannot be achieved depending on the method to set transfer current. It is thought that, for example, an appropriate current value in a transfer member on the downstream side is previously determined experimentally, and then the transfer current in the transfer member on the downstream side is uniformly set lower than that in the transfer member on the upstream side regardless of conditions and the image forming mode. However, in the case where the relationship between the transfer current in the transfer member on the upstream side and the transfer current in the transfer member on the downstream side is previously set in this manner, prevention of color shade change of a color image, ensuring of density, and control of toner consumption can be inadequately carried out, and thereby there is noted the problem that when the ambience is changed or the apparatus and material are changed, the color shade and the density of an image are varied. Further, toner consumption is inadequately controlled.

An object of the present invention is to solve the above problems and to realize an image forming apparatus capable of adequately carrying out prevention of color shade change of a color image, ensuring of density, and control of toner consumption.

SUMMARY (1) To achieve at least one of the above mentioned objects, an image forming apparatus reflecting one aspect of the present invention includes a plurality of toner image forming sections; a transfer body; a plurality of transfer members, each of which is provided corresponding to each of the toner image forming sections, to transfer toner images formed in the toner image forming sections onto the transfer body; a density sensor, arranged on a downstream side of the transfer members with respect to a moving direction of the transfer body, to measure a density of a toner image on the transfer body; and a control section, wherein the plurality of transfer members have a first transfer member arranged on an upstream side with respect to the moving direction of the transfer body and a second transfer member arranged on a downstream side from the first transfer member with respect to the moving direction of the transfer body; and the control section controls in a state where a transfer voltage is applied in the first transfer member and no transfer voltage is applied in the second transfer member, to form a first toner image on the transfer body by transferring a toner image having been formed in a first toner image fanning section arranged on an upstream side with respect to the moving direction of the transfer body among the toner image forming sections onto the transfer body, and to measure a first density of the first toner image using the density sensor, to apply transfer voltages in the first transfer member and the second transfer member, to form the second toner image on the transfer body by transferring the toner image having been formed in the first toner image forming section onto the transfer body, and to measure a second density of a second toner image using the density sensor by applying, and to determine a transfer current in each of the first transfer member and the second transfer member by the first density and the second density, (2) In the abovementioned image forming apparatus of item 1, wherein the transfer current flowing in the first transfer member has current values of a plurality of levels when the first toner image is formed; the first toner image contains a patch image having densities of a plurality of levels corresponding to the current values of the plurality of levels; and the control section grasps a first transfer characteristic of the first transfer member as a relationship between transfer current and transfer rate from the first density (3) In the abovementioned image forming apparatus of item 1 or item 2, wherein the control section controls so that predetermined standard transfer current flows in the first transfer member when the second toner image is formed.

(4) In the abovementioned image forming apparatus in any of items 1-3, wherein the transfer current flowing in the second transfer member has current values of a plurality of levels when the second toner image is formed; the second toner image contains a patch image having densities of a plurality of levels corresponding to the predetermined transfer current; and, the control section grasps a second transfer characteristic as a relationship between transfer current and transfer rate including back-transfer in the second transfer member from the second density.

(5) In the abovementioned image forming apparatus of item 4, wherein the control section determines the transfer current from the first transfer characteristic and the second transfer characteristic.

(6) In the abovementioned image forming apparatus in any of items 1-5, wherein each of the toner image forming sections is provided with an image carrier, a latent image forming member to form a latent image on the image carrier, and a developing member to develop the latent image; and, the control section controls in a state of where a toner image is formed on the image carrier in the fast toner image forming section, a transfer voltage is applied in the first transfer member, no transfer voltage is applied in the second transfer member to form a third toner image on the transfer body, to transfer the toner image onto the transfer body, to control a third density of the third toner image so as to be measured by the density sensor; and, to determine a developing voltage in the developing member when the first toner image and the second toner image are formed based on the third density.

(7) In the abovementioned image forming apparatus in any of items 1-6, wherein the control section determines the transfer current in the second transfer member is smaller than the transfer current in the first transfer member.

(8) In the abovementioned image forming apparatus of item 4, wherein a number of the plurality of the toner image forming sections is three or more, a number of the plurality of the transfer members is three or more and the control section grasps the first transfer characteristic of the first transfer member and the second transfer characteristic of the second transfer member wherein the transfer member on a most upstream side is assigned as the first transfer member and the transfer member on a most downstream side is assigned as the second transfer member and estimates a transfer characteristic of the transfer member between the transfer member on the most upstream side and the transfer member on the most downstream side from the grasped first transfer characteristic and the second transfer characteristic.

(9) In the abovementioned image forming apparatus in any of items 1-8, wherein the control section determines the transfer currents in the first transfer member and the second transfer member and thereafter sets a developing voltage in a developing member.

DESCRIPTION OF THE PREFERRED EMBODIMENT

The present invention will now be described with reference to an embodiment of the present invention but the present invention is not limited to the embodiment.

<Image Forming Apparatus>

Figure 1A:
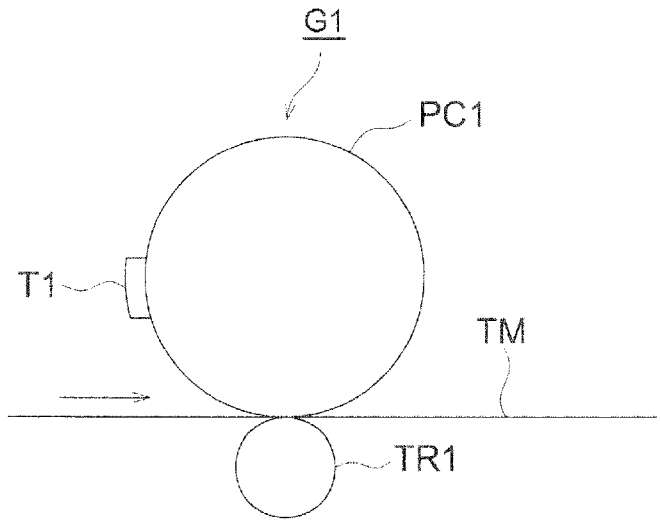
FIG. 1*a* is a view illustrating back-transfer.
Figure 1B:
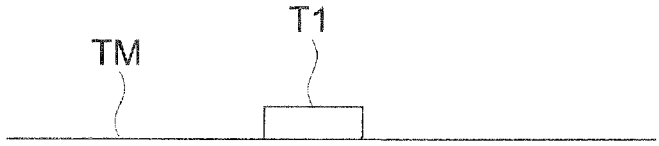
FIG. 1*b* is a view illustrating back-transfer.
Figure 1C:
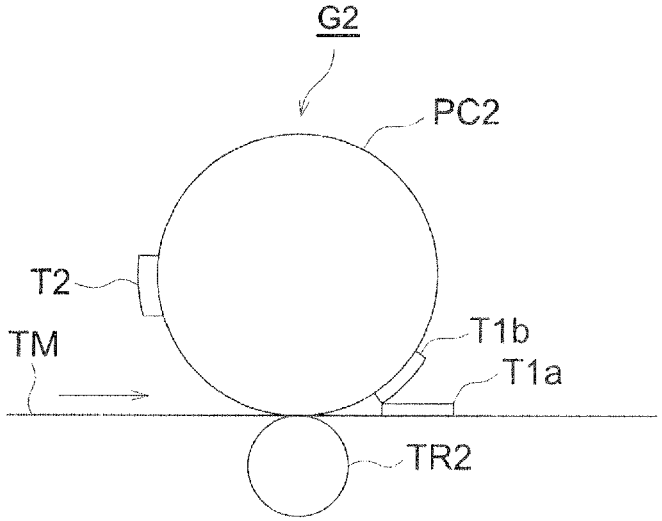
FIG. 1*c* is a view illustrating back-transfer.
Figure 1D:
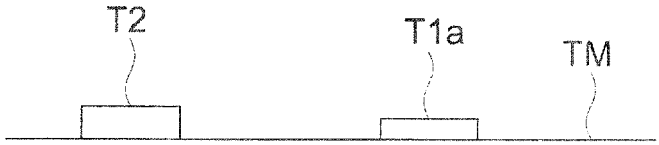
FIG. 1*d* is a view illustrating back-transfer.
Figure 2:
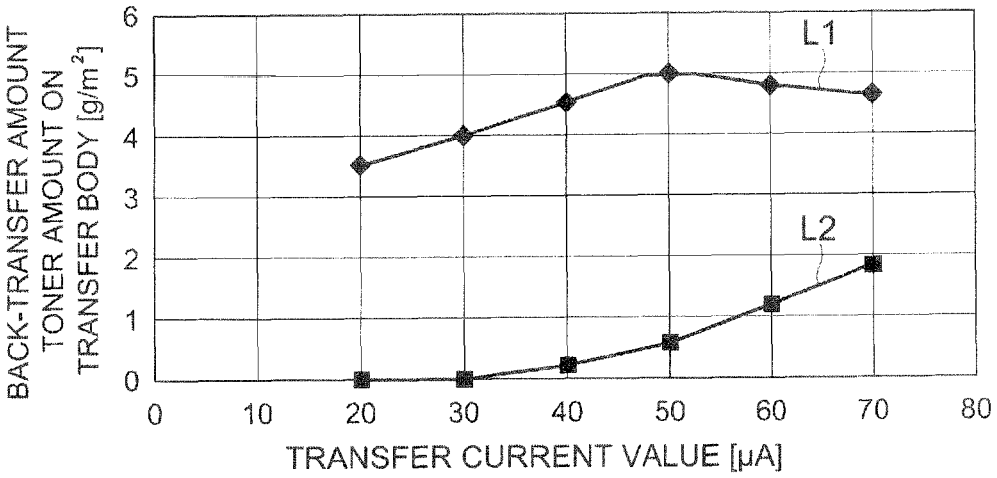
FIG. 2 is a graph showing transfer characteristics.
Figure 3:
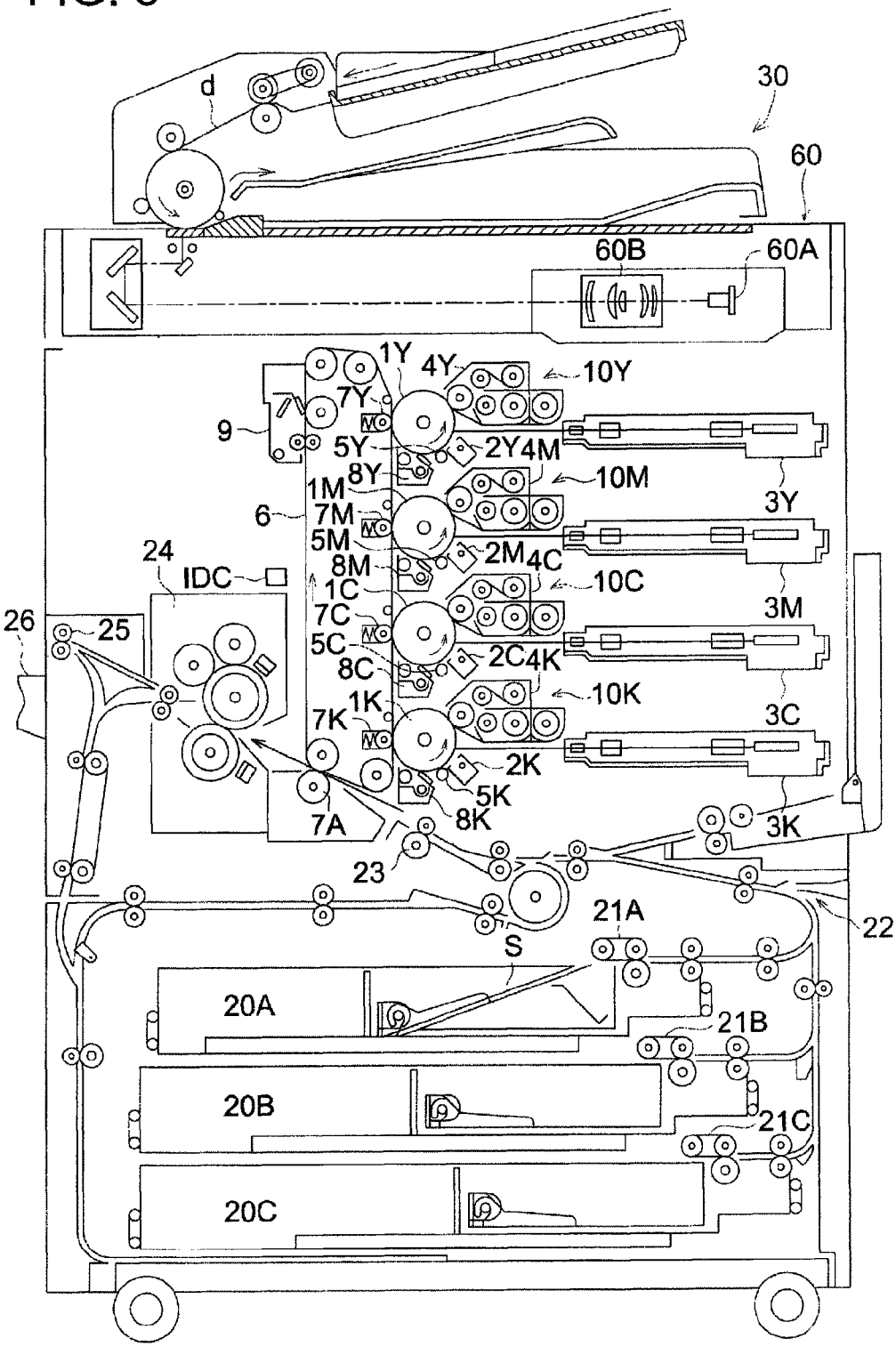
FIG. 3 is a view showing the entire constitution of an image forming apparatus according to an embodiment of the present invention.

FIG. 3 is a view showing the entire constitution of an image forming apparatus according to the embodiment of the present invention. The image forming apparatus shown in FIG. 1 is referred to as a tandem-type color image forming apparatus, incorporating an automatic document conveyance member 30, an image reading device 60, exposure devices 3Y, 3M, 3C, and 3K, drum-shaped photoreceptors 1Y, 1M, 1C, and 1K, charging devices 2Y, 2M, 2C, and 2K, developing members 4Y, 4M, 4C, and 4K, a fixing device 24, a belt-shaped intermediate transfer body 6, sheet feeding members 21A, 21B, and 21C, and a conveyance system 22.

The automatic document conveyance member 30 is a member to automatically convey a double-sided or single-sided document d. The image reading device 60 is a device to read image information using a movable optical system in which images of a large number of documents d fed from the document platen are focused on an imaging element 60A incorporating a CCD to be read using a reading optical system 60B having 3 movable mirrors and an imaging lens.

A toner image forming section 10Y, forming a yellow toner image, has a photoreceptor 1Y, a charging device 2Y, an exposure device 3Y, a developing member 4Y, a lubricant coating device 5Y, and a photoreceptor cleaning device 8Y. A toner image forming section 10M, forming a magenta toner image, has a photoreceptor 1M, a charging device 2M, an exposure device 3M, a developing member 4M, a lubricant coating device 5M, and a photoreceptor cleaning device 8M. A toner image forming section 10C, forming a cyan toner image, has a photoreceptor 1C, a charging device 2C, an exposure device 3C, a developing member 4C, a lubricant coating device 5C, and a photoreceptor cleaning device 8C. A toner image forming section 10K, forming a black toner image, has a photoreceptor 1K, a charging device 2K, an exposure device 3K, a developing member 4K, a lubricant coating device 5K, and a photoreceptor cleaning device 8K. The charging device 2Y and the exposure device 3Y, the charging device 2M and the exposure device 3M, the charging device 2C and the exposure device 3C, and the charging device 2K and the exposure device 3K each constitute a latent image forming member.

The intermediate transfer body 6 as the transfer body is an endless belt, and stretched and supported by a plurality of rollers, moving as shown by the arrow. Transfer members 7Y, 7M, 7C, and 7K each having a primary, transfer roller transfer toner images having been formed in the toner image forming sections 10Y, 10M, 10C, and 10K onto the moving intermediate transfer body 6.

The intermediate transfer body 6 orbits clockwise as shown by the arrow. The toner image forming section 10Y, the toner image forming section 10M, the toner image forming section 10C, and the toner image forming section 10K are arranged in this sequential order from the upstream side with respect to the moving direction of the intermediate transfer body 6. In the same manner, the transfer member 7Y, the transfer member 7M, the transfer member 7C, and the transfer member 7K are arranged in this sequential order from the upstream side with respect to the moving direction of the intermediate transfer body 6.

Signals of image information having been focused on the imaging element 60A are sent to an unshown image processing section. The image processing section carries out analog processing, VD conversion, shading correction, and image compression processing to then send the signal of each color to the exposure devices 3Y, 3M, 3C, and 3K.

In the exposure devices 3Y, 3M, 3C, and 3K, a semiconductor laser serving as a laser light source is used. A light beam having been ejected from the semiconductor laser is formed as a scanning light beam by an optical element such as a polygon mirror to enter the photoreceptors 1Y, 1M, 1C, and 1K as scanned bodies and thereby electrophotographic latent images of the individual colors are formed.

Toner images of the individual colors having been formed in the toner image forming sections 10Y, 10M, 10C, and 10K are sequentially transferred onto the rotating intermediate transfer body 6 by the transfer members 7Y, 7M, 7C, and 7K to form a composed color image. A recording medium S stored in any of the sheet feeding cassettes 20A, 20B, and 20C is fed by a corresponding one of the sheet feeding members 21A, 21B, and 21C and passed through the conveyance System 22, followed by being conveyed to a secondary transfer section with right timing by a registration roller 23 to transfer the color image onto the recording medium S in the secondary transfer device 7A. Then, the recording medium S on which the color image has been transferred is subjected to fixing by the fixing device 24 and nipped by the sheet discharging roller 25 to be stacked on the sheet discharging tray 26 outside the machine.

On the other hand, after the color image has been transferred onto the recording medium S by the transfer device 7A, the intermediate transfer body 6 having separated the recording medium S is cleaned by the intermediate transfer body cleaning device 9.

The toner image farming sections 10Y, 10M, 10C, and 10K and the intermediate transfer body 6 are incorporated in the image forming apparatus as a removable process unit.

The IDC is a density sensor to measure the density of a toner image on the intermediate transfer body 6 and has a light emitting element for irradiation of light toward the intermediate transfer body 6 and a light receiving element to receive reflective light from the intermediate transfer body 6 to measure the densities of a yellow toner image, a magenta toner image, a cyan toner image, and a black toner image being formed on the intermediate transfer body 6.

<Determination of Transfer Current>

Figure 4:
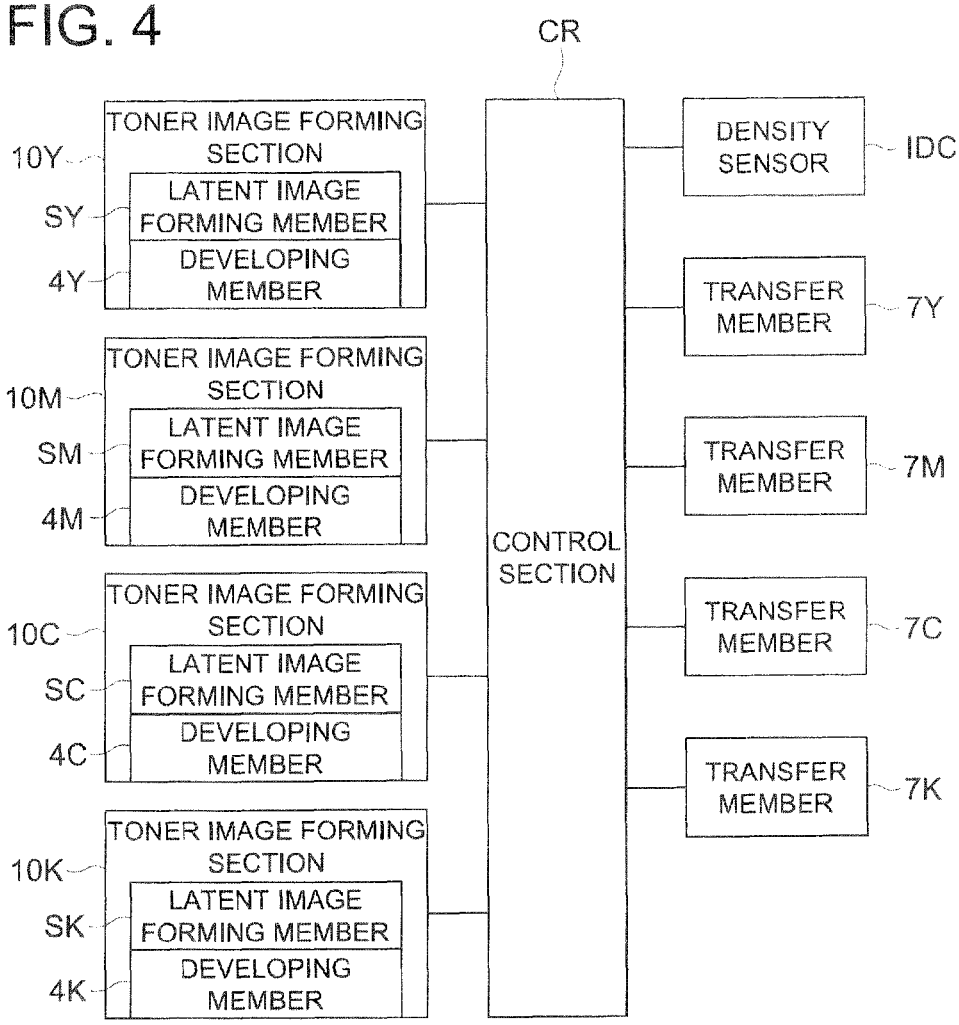
FIG. 4 is a block diagram of the control system to set transfer current.

FIG. 4 is a block diagram of the control system to set transfer current.

The control section CR controls the toner image forming sections 10Y, 10M, 10C, and 10K and the transfer members 7Y, 7M, 7C, and 7K, and captures an output of the density sensor IDC as density information during controlling. The toner image forming section 10Y has a latent image forming member SY containing a charging device 2Y and an exposure device 3Y and a developing member 4Y. The toner image forming section 10M has a latent image forming member SM containing a charging device 2M and an exposure device 3M and a developing member 4M. The toner image forming section 10C has a latent image forming member SC containing a charging device 2C and an exposure device 3C and a developing member 4C. The toner image timing section 10K has a latent image forming member SK containing a charging device 2K and an exposure device 3K and a developing member 4K.

Figure 5:
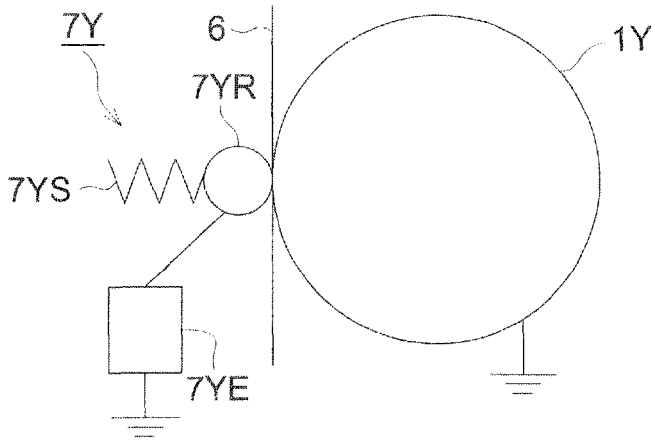
FIG. 5 is a view showing the constitution of a transfer member.

FIG. 5 shows the constitution of a transfer member. FIG. 5 shows the transfer member 7Y. However, the transfer members 7M, 7C, and 7K also have the constitution shown in FIG. 5.

Figure 6:
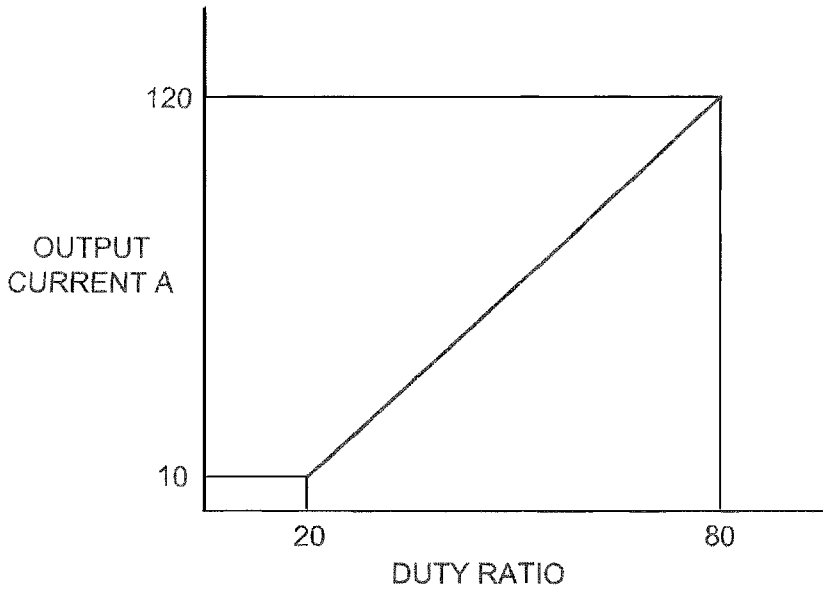
FIG. 6 is a graph showing the output of the power source of a transfer member.

The transfer member 7Y incorporates a transfer roller 7YR, a spring 7YS, and a power source 7YE. The transfer roller 7YR is energized by the spring 7YS to press the intermediate transfer body 6 against the photoreceptor 1Y. The transfer roller 7YR is formed of a conductive rubber roller, and the power source 7YE outputs transfer current, which is variable current, to apply a transfer voltage to the transfer roller 7YR. The output current value of the power source 7YE is changed by changing the duty ratio of pulse current as shown in FIG. 6.

The control section CR determines the transfer current in the transfer process to transfer toner images having been formed in the toner image forming sections 10Y, 10M, 10C, and 10K onto the intermediate transfer body 6 serving as the transfer body, namely, the transfer current each in the transfer members 7Y, 7M, 7C, and 7K, via a control process as described below.

Figure 7:
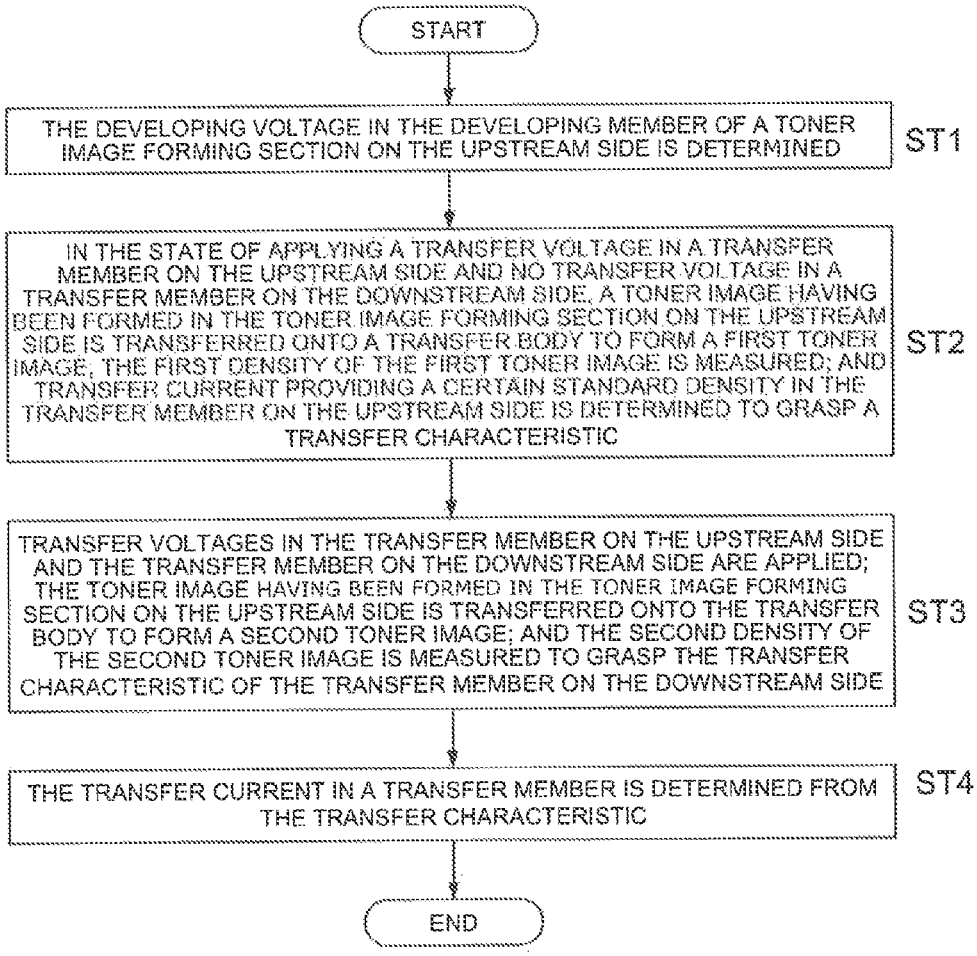
FIG. 7 is a flowchart showing the determination process to determine transfer current.

FIG. 7 shows the determination process to determine transfer current.

In step ST1, the developing voltage in the developing member 4Y of the toner image forming section 10Y as a first toner image forming section arranged on the most upstream side with respect to the moving direction of the intermediate transfer body 6 is determined. The developing voltage is determined to allow the density of a toner image containing a patch image of uniform density formed during determination of transfer current to be appropriate.

In step ST2, the developing voltage having been determined in ST1 is set; a toner image containing a patch image is formed on the photoreceptor 1Y serving as an image carrier in the toner image forming section 10Y; the toner image is transferred onto the intermediate transfer body 6 by the transfer member 7Y serving as a first transfer member arranged on the most upstream side with respect to the moving direction of the intermediate transfer body 6; and a first toner image is formed on the intermediate transfer body 6. The first toner image forming section is a toner image forming section arranged on the upstream side with respect to the moving direction of the intermediate transfer body 6 as the transfer body, and the first transfer member is a transfer member arranged on the upstream side with respect to the moving direction of the intermediate transfer body 6.

Then, the first density of the first toner image is measured by the density sensor IDC, and from the first density, a certain standard density, e.g., the transfer current in the transfer member 7Y to provide the maximum density is determined.

In the transfer to form the first toner image on the intermediate transfer body 6, transfer current is applied in the transfer member 7Y. However, in the transfer members 7M, 7C, and 7K each serving as a second transfer member, transfer is carried out under the condition of no transfer voltage application, namely, under a condition in which only the power source 7YE of the transfer member 7Y is switched on and the power sources of the transfer members 7M, 7C, and 7K are switched off. The second transfer member is a transfer member arranged on the downstream side with respect to the moving direction of the intermediate transfer body 6.

Figure 8:
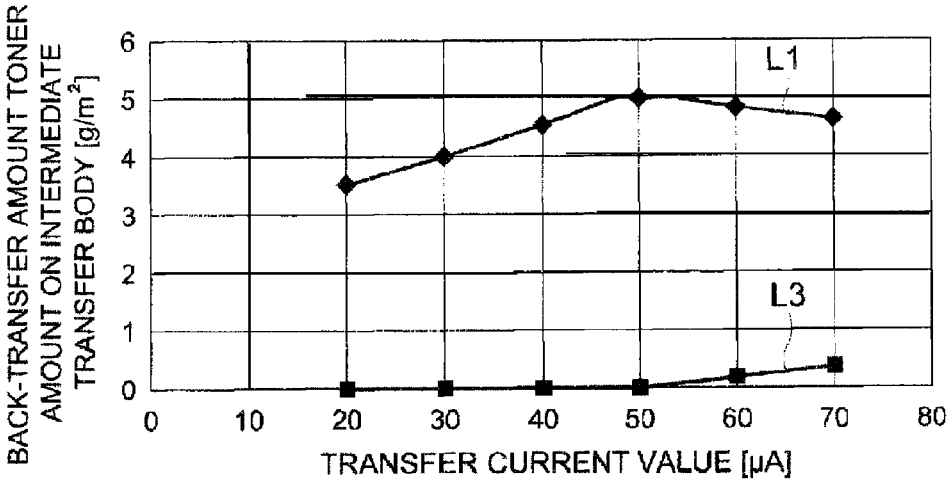
FIG. 8 is a view showing transfer characteristics.

Curve L1 of FIG. 8 shows a transfer characteristic as the relationship between transfer current and transfer rate, e.g., the toner amount change of a toner image on the intermediate transfer body 6 versus the change of the transfer current in the transfer member 7Y. As shown by curve L1, to a certain value (50 μA in the figure), with the increase of the transfer current, the toner amount increases, but in the range more than the certain value, with the increase of the transfer current, the toner amount decreases. It is thought that such a saturation phenomenon of the toner amount results from occurrence of back-transfer as shown by curve L3 due to toner reverse charging via overcurrent.

The transfer to form a first toner image is carried out, for example, with transfer current having current values of a plurality of levels at intervals of 10 μA from 10 μA-70 μA. ST2 determines a standard density on curve L1, e.g., the transfer current at the maximum density.

In step ST3, a toner image containing a patch image is formed on the photoreceptor 1Y at the developing voltage having been set in ST1; a transfer voltage with the transfer current having been determined in ST2 is applied to the transfer member 7Y and also a transfer voltage is each applied to the transfer members 7M, 7C, and 7K to transfer toner images onto the intermediate transfer body 6; and a second toner image is formed on the intermediate transfer body 6. The transfer current determined in ST2 is one example of predetermined standard transfer current.

Then, the second density of the second toner image is measured by the density sensor IDC to grasp the transfer characteristics of the transfer members 7M, 7C, and 7K from the second density.

In step ST4, the transfer currents in the transfer members 7Y, 7M, 7C, and 7K are determined.

Figure 9:
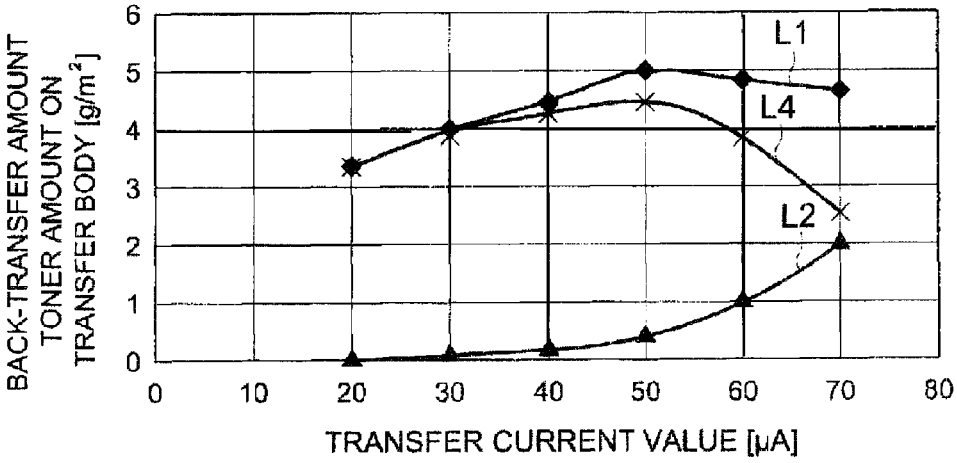
FIG. 9 is a view showing transfer characteristics and back-transfer characteristics.

FIG. 9 shows transfer characteristics and back-transfer characteristics. In FIG. 9, the vertical axis represents the toner amount and the back-transfer amount on the intermediate transfer body 6. The horizontal axis represents the transfer currents of the transfer members 7Y and 7M. Curve L1 shows the density change of a toner image formed on the intermediate transfer body 6 when transfer has been carried out in the state of applying a transfer voltage to the transfer member 7Y and of applying no transfer voltage to the transfer member 7M, in other words, showing the transfer characteristic as transfer current vs. transfer rate in the transfer member 7Y. Curve L2 shows the back-transfer characteristic in the transfer member 7M when transfer has been earned out in the state of applying a transfer voltage to the transfer members 7Y and 7M. Further, curve L4 shows the toner amount of a toner image formed in the intermediate transfer body 6 when transfer has been earned out in the state of applying a transfer voltage to the transfer members 7Y and 7M, in other words, showing the transfer characteristic including back-transfer in the transfer member 7M. Curve 4 can be referred to as one formed from the value obtained by subtracting curve L2 from curve L1.

Incidentally, the transfer characteristics shown in FIG. 9 are characteristics when as the same transfer current is allowed to flow in the transfer member 7Y and the transfer member 7M, the transfer current is changed.

As shown by curve L4 representing a transfer characteristic, the toner amount of a toner image on the intermediate transfer body 6 more largely decreases than in curve L1 due to back-transfer in the transfer member 7M with the increase of the transfer current.

Figure 10:
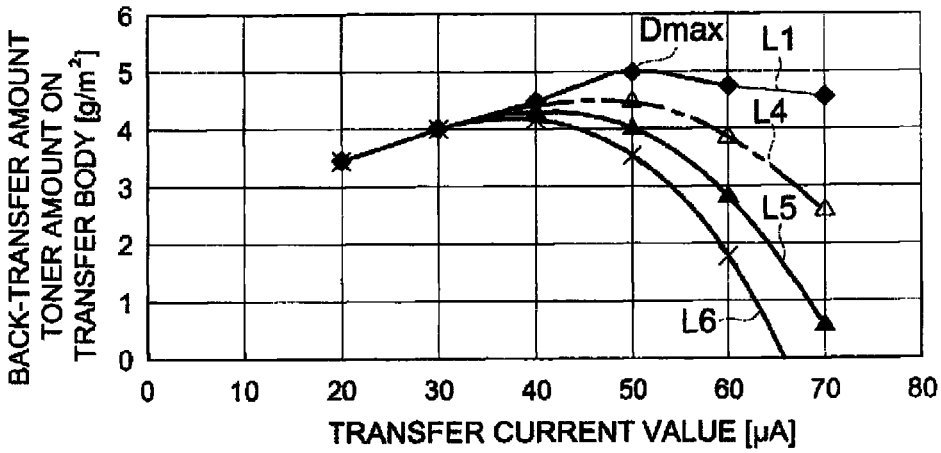
FIG. 10 is a graph showing transfer characteristics including back-transfer in a plurality of transfer members.

FIG. 10 is a graph showing the transfer characteristics including back-transfer in a plurality of transfer members. In FIG. 10, the vertical axis represents the toner amount and the back-transfer amount on the intermediate transfer body 6. The horizontal axis represents the transfer currents of the transfer members 7Y, 7M, 7C, and 7K. FIG. 10 shows the situation that a toner image having been formed in the toner image forming section 10Y is passed through the transfer member on the downstream side and transferred onto the intermediate transfer body 6 and then the toner amount of a toner image formed on the intermediate transfer body 6 is decreased due to back-transfer in the transfer member on the downstream side. Curve L4, curve L5, and curve L6 represent the transfer characteristic including back-transfer of the transfer member 7M, the transfer characteristic of the transfer member 7C including back-transfer of the transfer members 7M and 7C, and the transfer characteristic of the transfer member 7K including back-transfer of the transfer members 7M, 7C, and 7K, respectively. The difference between curve L1 and curve L4 represents the back-transfer characteristic of the transfer member 7M. The difference between curve L4 and curve L5 represents the back-transfer characteristic of the transfer member 7C. The difference between curve L5 and curve L6 represents the back-transfer characteristic of the transfer member 7K. Herein, curve L1 is one obtained via measurement by the density sensor IDC when transfer has been carried out in the state of applying a transfer voltage in the transfer member 7Y and no transfer voltage in the transfer members 7M, 7C, and 7K. Curve L4 is one obtained via measurement by the density sensor IDC when transfer has been carried out in the state of applying a transfer voltage in the transfer members 7Y and 7M and no transfer voltage in the transfer members 7C, and 7K. Curve L5 is one obtained via measurement by the density sensor IDC when transfer has been carried out in the state of applying a transfer voltage in the transfer members 7Y, 7M, and 7C and no transfer voltage in the transfer member 7K, Curve L6 is one obtained via measurement by the density sensor IDC when transfer has been carried out in the state of applying a transfer voltage in the transfer member 7Y, 7M, 7C, and 7K.

Incidentally, the transfer characteristics shown in FIG. 10 are also characteristics when as the same transfer current is allowed to flow in the transfer members 7Y, 7M, 7C, and 7K, the transfer current is changed, in the same manner as in the transfer characteristics of FIG. 9.

In ST3, the transfer characteristics shown by curves L4, L5, and L6 are grasped.

In step ST4, the control section CR determines the transfer currents in the transfer members 7Y, 7M, 7C, and 7K from the transfer characteristics shown in FIG. 10, namely, from curves L1, L4, L5, and L6.

Determination of the transfer current is made based on the following 3 points as the basis of judgment. (1) Transfer rate is increased as much as possible to ensure the density of a toner image. (2) The variation of the color shade of a color image is inhibited. Since the color of a color image is determined by the amount ratio of color toners to form a color image, a consideration is made so that the amount ratio among a yellow toner, a cyan toner, and a magenta toner is not changed to determine transfer current Herein, in this case, the order of color superimposition is considered. In the intermediate transfer body 6, toner images are superimposed in order of a yellow toner image, a magenta toner image, a cyan toner image, and a black toner image.

An example using a yellow toner image and a magenta toner image is described below. When a magenta toner image is passed through the transfer member 7M to be transferred, the return of a yellow toner image is inhibited by the magenta toner image. On the other hand, the decrease of the toner amount shown by curve L4 of FIG. 9 due to back-transfer occurs when a yellow toner image is passed through the transfer member 7M with no interposition of a magenta toner image.

Therefore, in image formation in which a yellow toner image and a magenta toner image are superimposed to be formed on the intermediate transfer body 6, the decrease amount of the yellow toner due to transfer-back is less than in curve L4, namely, the downward-sloping portion of curve L4 is lifted up more than in FIG. 8.

When transfer current is determined in consideration of no occurrence of color shade change, superimposition of a plurality of toner images is considered in this manner. (3) Back-transfer is allowed to decrease as much as possible.

When the toner amount of a toner image on the intermediate transfer body 6 decreases due to back-transfer, image density also decreases. To inhibit such a decrease in image density, transfer current is set so as for back-transfer to decrease to a maximum extent.

As shown by curve 12 of FIG. 9, since back-transfer increases with the increase of the transfer current, to inhibit the back-transfer, it is preferable that the transfer current of an upstream side transfer member be maximized and the transfer current of a downstream side transfer member be at most the above transfer current.

In an image forming apparatus provided with at least 3 transfer members, it is preferable that the transfer current of the most upstream side transfer member be maximized and the transfer currents of the downstream side transfer members be at most the transfer current of the most upstream side transfer member.

The transfer currents having been determined via the above process occasionally deviate from a current value to form a toner image of maximum density at maximum transfer rate. In this case, namely, since the transfer currents have been set with a deviation from a current value to maximize transfer rate, the density of a toner image is decreased. To compensate this density decrease, a correction is made so as to form a toner image of maximum density in development.

When density correction is carried out by development in this manner, a problem such that toner consumption and waste toner amount are increased is produced. With regard to inhibition of toner returning, the viewpoint of controlling toner consumption and waster toner amount is also taken into account.

In determination of transfer current in consideration of above (1)-(3), the relationship among transfer current change, image density decrease, color shade change, and toner consumption change is examined in advance and thereby a table is produced. Then, the control section CT refers to the thus-produced table for determination.

After the transfer current has been determined in ST4, the control section CR forms a toner image for image stabilizing control, detects the density of the formed toner image, and then carries out image stabilizing control to control the exposure amount in the exposure device and the developing voltage in the developing member based on the detected density. Such image stabilizing control is described in, for example, Unexamined Japanese Patent Application Publication Nos. 2006-189562 and 2007-65269.

Figure 11:
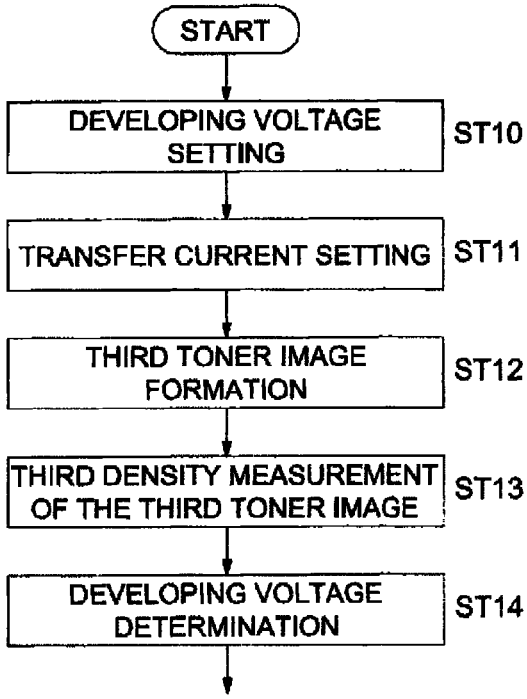
FIG. 11 is a view showing details of ST1 in FIG. 7.

FIG. 11 shows details of ST1 in FIG. 7.

In step ST10, the developing voltage of the developing member 4Y of the toner image forming section 10Y is set. The developing voltage set here has values of a plurality of levels having been previously determined.

In step ST11, the transfer current in the transfer member 7Y is set. This transfer current has a current value of a single level having been previously determined.

In step ST12, under a condition formed by the developing voltage having been set in ST10 and the transfer current having been set in ST11, a latent image is formed on the photoreceptor 1Y and then a toner image is formed by development to form a third toner image on the intermediate transfer body 6 via transfer.

Figure 12:
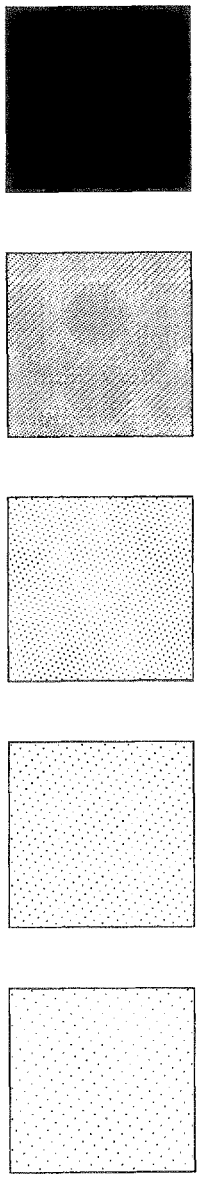
FIG. 12 is a view showing a third toner image.

FIG. 12 shows a third toner image.

The third toner image is formed on the intermediate transfer body 6 in such a manner that exposure is carried out at maximum exposure amount or saturated exposure amount to form a latent image, which is then developed at developing voltages of a plurality of levels and transferred. As shown in FIG. 12, a plurality of patch images having different densities corresponding to the developing voltages are contained.

In step ST13, the density sensor MC detects the third density of the third toner image.

In step ST14, on the basis of the detection result of the density sensor IDC, the developing voltage to form a toner image of appropriate density is determined (ST14). The developing voltage determined in ST14 is a voltage of a single level to form a toner image of appropriate density at the maximum exposure amount.

Figure 13:
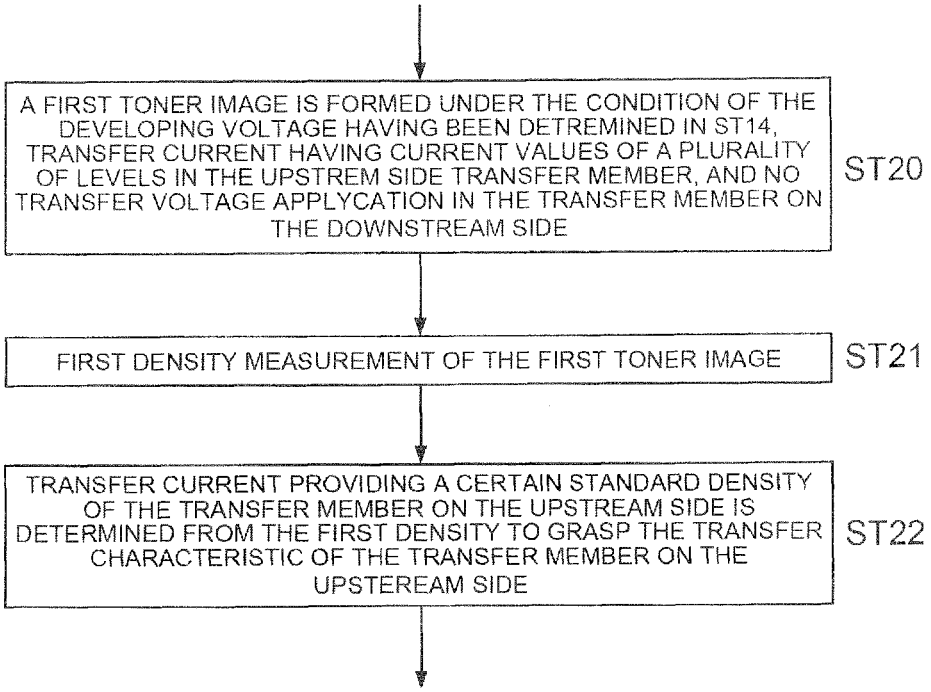
FIG. 13 is a view showing details of ST2 in FIG. 7.

FIG. 13 shows details of ST2 in FIG. 7.

In step ST20, the developing voltage in the developing member 4Y and the transfer current in the transfer member 7Y are set.

The developing voltage to be set is the one having been determined in ST14 in FIG. 11. Further, the transfer current to be set is a transfer current of a plurality of levels having been previously set.

Further, via toner image formation in the toner image forming section 10Y and transfer of the transfer member 7Y, a first toner image is formed on the intermediate transfer body 6.

The first toner image contains a plurality of patch images having different densities of a plurality of levels corresponding to the transfer current of a plurality of levels, resembling the third toner image shown in FIG. 12. In transfer to form the first toner image, transfer current is applied in the transfer member 7Y but no transfer current is applied in the transfer members 7M, 7C, and 7K.

In ST21, the density sensor IDC measures the first density of the first toner image.

In step ST22, a certain standard density, for example, transfer current providing maximum density is determined from the first density having been measured in ST22.

The first density of the first toner image is, for example, the density to form curve L1 in FIGS. 8, 9, and 10, determining the transfer current providing maximum density and also capturing the transfer characteristic of the transfer member 7Y as in curve L1.

Figure 14:
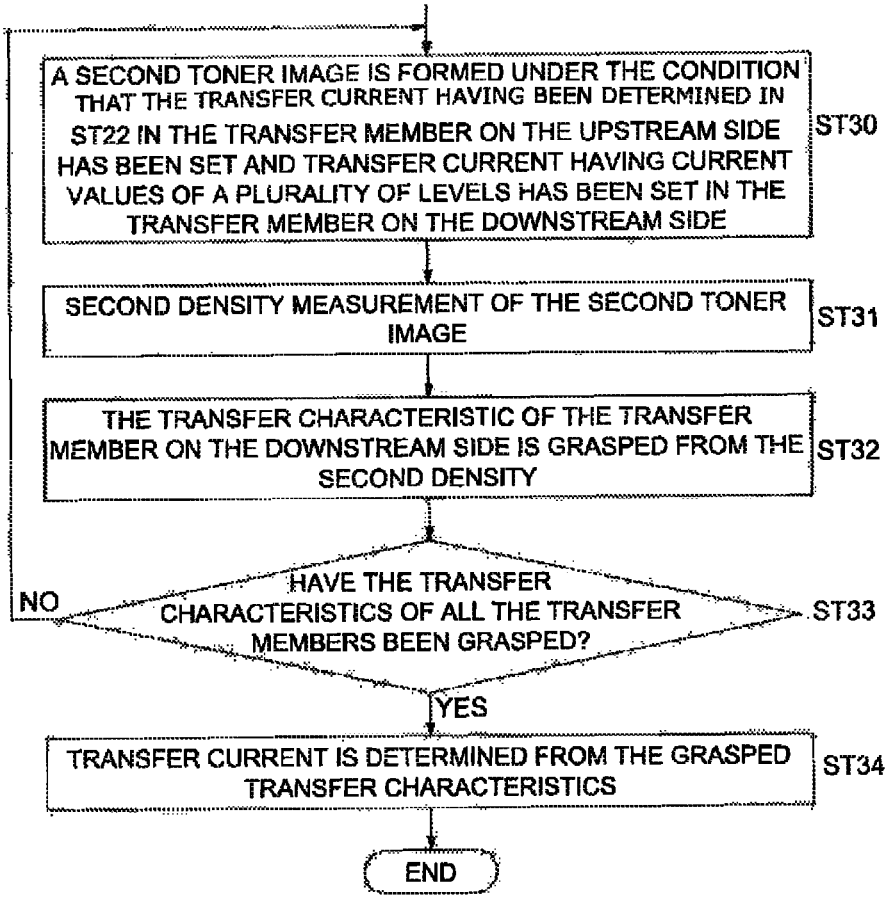
FIG. 14 is a view showing details of ST3 in FIG. 7.

FIG. 14 shows details of ST3 of FIG. 7.

In ST30, a second toner image is formed on the intermediate transfer body 6.

In formation of the second toner image, a toner image is formed on the photoreceptor 1Y at the developing voltage having been determined in ST14 of FIG. 11, and then via application of a transfer voltage at the transfer current in the transfer member 7Y having been determined in ST22 of FIG. 13 and of a transfer voltage in the transfer member 7M which is the transfer member on the downstream side, transfer is carried out.

The transfer current in the transfer member 7M has current values of a plurality of levels. Therefore, the second toner image contains a plurality of patch images having different densities corresponding to the transfer current of a plurality of levels in the transfer member 7M, resembling the third toner image shown in FIG. 12.

Figure 15:
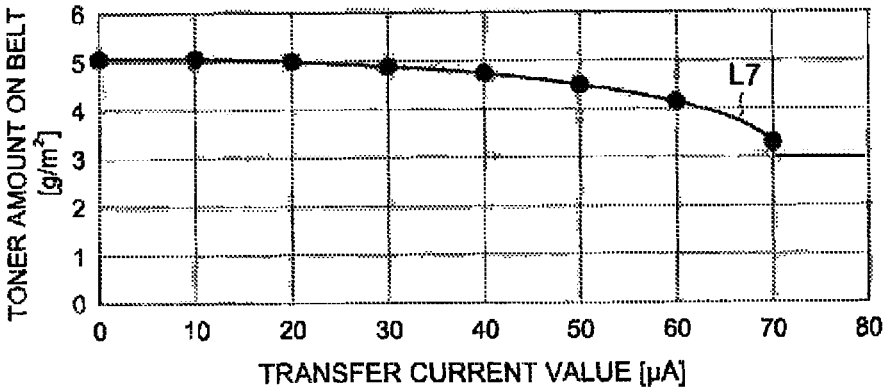
FIG. 15 is a graph showing transfer-back characteristic.

In ST13, the density sensor DC measures the second density of the second tone image. Based on density measurement of ST31, the second density changing with the change of the transfer current in the transfer member 7M is acquired. FIG. 15 shows this density change. In FIG. 15, curve L7 shows the second density of the second toner image on the intermediate transfer body 6 in which the transfer current of the transfer member 7Y is set at the value to form maximum density Dmax in FIG. 10 and then the transfer current of the transfer member 7M is allowed to widely change. As shown in the figure, the second density will decrease via back-transfer, decreasing with the increase of the transfer current in the transfer member 7M.

In ST32, the control section CR forms curve L4 in FIG. 10 from curve L7 and then captures the transfer characteristic of the transfer member 7M. To form curve L4 from curve L7, in plural points on curve L1 in FIG. 10, the density decrease rate of curve L7 in each of the corresponding plural points is multiplied. The transfer characteristic grasped in ST32 is the transfer characteristic of a toner image in which a toner image having been formed in the toner image torturing section 10Y is transferred onto the intermediate transfer body 6 by the transfer member 7Y and passed through the transfer member 7M to be formed on the intermediate transfer body 6, namely, being the transfer characteristic of the transfer member 7M.

In this manner, the transfer characteristic of the transfer member 7M is grasped in which the transfer member 7Y is assigned as a first transfer member on the upstream side and the transfer member 7M is assigned as a second transfer member on the downstream side.

Subsequently, the transfer member 7Y is assigned as a first transfer member on the upstream side and the transfer members 7M and 7C are assigned as second transfer members on the downstream side to execute ST30-ST32. Further, the transfer member 7Y is assigned as a first transfer member on the upstream side and the transfer members 7M, 7C, and 7K are assigned as second transfer members on the downstream side to execute ST30-ST32.

ST30-ST33 are repeated, and then in the stage where the transfer characteristics of the transfer members 7C and 7K, namely, the transfer characteristics shown by curves L5 and L6 of FIG. 10 have been grasped (Y of ST33), i.e., in step ST34, the transfer current in each of the transfer members 7Y, 7M, 7C, and 7K is determined from the grasped transfer characteristics shown by curves L1, L4, L5, and L6.

Incidentally, the determination process shown in FIG. 14 can be simplified as described below.

In ST30, the transfer members 7M, 7C, and 7K are applied with, a transfer voltage using transfer current having current values of a plurality of levels to grasp the transfer characteristic shown by curve L6 of FIG. 10, namely, a transfer characteristic including back-transfer in the transfer members 7M, 7C, and 7K.

From curve L1 having been grasped in ST22 and curve L6 having been grasped in ST32, curves L4 and L5 are estimated.

To further increase accuracy, using the following process, transfer current can also be determined.

The toner image forming section 10Y is assigned as the toner image fanning section on the most upstream side and the transfer member 7Y is assigned as the transfer member on the most upstream side to form a yellow toner image and via the above process, with respect to the yellow toner image, the transfer characteristic of the transfer member 7Y and a transfer characteristic including back-transfer in the downstream are grasped. Then, with respect to a magenta toner image, the transfer characteristic of the transfer member 7M which is the transfer member on the most upstream side and a transfer characteristic including back-transfer in the downstream are grasped. Further, with respect to a cyan toner image, the transfer characteristic of the transfer member 7C which is the transfer member on the most upstream side and a transfer characteristic including back-transfer in the downstream are grasped. Lastly, with respect to a black toner image, the transfer characteristic of the transfer member 7K is grasped.

On the basis of the transfer characteristics of the yellow toner image, the magenta toner image, the cyan toner image, and the black toner image having been grasped in this manner, the transfer currents of the transfer members 7Y, 7M, 7C, and 7K are determined.

In transfer current determination, the viewpoints (1)-(3) described above are taken into account.

EXAMPLE

Table 1 shows one example of the transfer current determined by the above-described transfer current control process.

In Table 1, in case A, uniform transfer current was applied; in case B, a setting was made to aim at controlling toner consumption; and in case C, a setting was made to aim at inhibiting the variation of the color shade of a color image.

TABLE 1

| Color | Yellow | Magenta | Cyan | Black |
|---|---|---|---|---|
| A | 60 μA | 60 μA | 60 μA | 60 μA |
| B | 55 μA | 58 μA | 60 μA | 50 μA |
| C | 55 μA | 55 μA | 55 μA | 50 μA |

The variation of the color shade of a color image increases with the increase of back-transfer. Namely, as the difference between curve L1 and curve L4, the difference between curve L4 and curve L5, and the difference between curve L5 and curve L6 increase, the variation of the color shade also increases. Therefore, to inhibit color shade variation, transfer current is preferably set at a left-leaning point to a maximum extent on each curve in FIG. 10.

To inhibit color shade variation in a color image, from such a point of view, the transfer current is set. However, as shown by curves L1, L4, L5, and L6, on the left side of 50 μA, as the transfer current decreases, the transfer rate also decreases, and therefore, in consideration of ensuring of the transfer rate and color shade variation, the transfer current is determined.

On the other hand, to control toner consumption, the transfer current is determined so as for the transfer rate to increase as much as possible. In the case of low transfer rate, developing density is increased to compensate image density decrease due to the low transfer rate. However, the increase of the transfer rate makes it possible that the developing density is controlled at a low level, resulting in controlling toner consumption.

In Table 1, in case B, transfer current close to the point providing maximum density Dmax in FIG. 10 is set. In contrast, in case C, transfer current is set at a low level and thereby color shade variation is inhibited.

Figure 16:
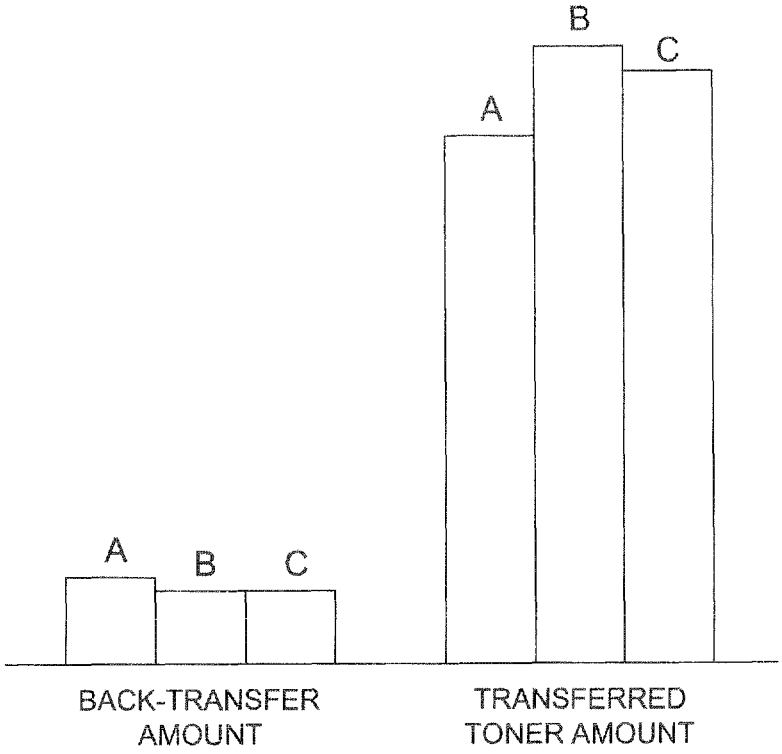
FIG. 16 is a view showing back-transfer amount and transfer toner amount.

FIG. 16 shows the amount of a toner having been transferred onto the intermediate transfer body (transferred toner amount) and back-transfer amount.

In case A in which uniform transfer current is set, the transferred toner amount is smallest and the back-transfer amount is largest. In case B, the transferred toner amount is largest and the back-transfer amount is small. In case C, the transferred toner amount is of a medium level and the back-transfer amount is small.

In the embodiment, on the basis of the first density of a first toner image having been transferred under the condition of no occurrence of back-transfer and the second density of a second toner image having beta transferred under the condition of occurrence of back-transfer, the transfer current in a transfer member is determined. Thereby, density variation due to ambience variation and the change of the apparatus and material is sufficiently inhibited and then an image forming apparatus to stably form an image of high image quality is realized.

What is claimed is:

1. An image forming apparatus comprising a plurality of toner image forming sections;

a transfer body;

a plurality of transfer members, each of which is provided corresponding to each of the toner image forming sections, to transfer toner images formed in the toner image forming sections onto the transfer body;

a density sensor, arranged on a downstream side of the transfer members with respect to a moving direction of the transfer body, to measure a density of a toner image on the transfer body; and a control section, wherein the plurality of transfer members have a first transfer member arranged on an upstream side with respect to the moving direction of the transfer body and a second transfer member arranged on a downstream side from the first transfer member with respect to the moving direction of the transfer body; and the control section controls in a state where a transfer voltage is applied in the first transfer member and no transfer voltage is applied in the second transfer member, to form a first toner image on the transfer body by transferring a first toner image having been formed in a first toner image forming section arranged on an upstream side with respect to the moving direction of the transfer body among the toner image forming sections onto the transfer body, and to measure a first density of the first toner image using the density sensor, to apply transfer voltages in the first transfer member and the second transfer member, to form a second toner image on the transfer body by transferring a second, toner image having been formed in the first toner image forming section onto the transfer body, and to measure a second density of the second toner image using the density sensor and to determine a transfer current in each of the first transfer member and the second transfer member by the first density and the second density.

2. The image forming apparatus of claim 1, wherein the transfer current flowing in the first transfer member has current values of a plurality of levels when the first toner image is formed;

the first toner image contains a patch image having densities of a plurality of levels corresponding to the current values of the plurality of levels; and the control section determines a first transfer characteristic of the first transfer member as a relationship between transfer current and transfer rate from the first density.

3. The image forming apparatus, of claim 2, wherein the transfer current flowing in the second transfer member has current values of a plurality of levels when the second toner image is formed;

the second toner image contains a patch image having densities of a plurality of levels corresponding to the predetermined transfer current; and, the control section determines a second transfer characteristic as a relationship between transfer current and transfer rate including back-transfer in the second transfer member from the second density.

4. The image forming apparatus of claim 3, wherein the control section determines the transfer current from the first transfer characteristic and the second transfer characteristic.

5. The image forming apparatus of claim 3, wherein a number of the plurality of the toner image forming sections is three or more, a number of the plurality of the transfer members is three or more; and the control section determines the first transfer characteristic of the first transfer member and the second transfer characteristic of the second transfer member wherein the transfer member on a most upstream side is assigned as the first transfer member and the transfer member on a most downstream side is assigned as the second transfer member and estimates a transfer characteristic of the transfer member between the transfer member on the most upstream side and the transfer member on the most downstream side from the determined first transfer characteristic and the second transfer characteristic.

6. The image forming apparatus of claim 1, wherein the control section controls so that a predetermined standard transfer current flows in the first transfer member when the second toner image is formed.

7. The image forming apparatus of claim 1, wherein each of the toner image forming sections is provided with an image carrier, a latent image forming member to form a latent image on the image carrier, and a developing member to develop the latent image; and, the control section controls in a state of where a third toner image having been formed on the image carrier in the first toner image forming section, a transfer voltage is applied in the first transfer member, no transfer voltage is applied in the second transfer member to form a third toner image on the transfer body, to transfer the third toner image onto the transfer body, to control a third density of the third toner image so as to be measured by the density sensor; and to determine a developing voltage in the developing member of the first toner image forming section when the first toner image and the second toner image are formed based on the third density.

8. The image forming apparatus of claim 1, wherein the control section, determines the transfer current in the second transfer member is smaller than the transfer current in the first transfer member.

9. The image forming apparatus of claim 1, wherein the control section determines the transfer currents in the first transfer member and the second transfer member and thereafter sets a developing voltage in a developing member.

* * * * *